US009373430B2

(12) United States Patent
Wei et al.

(10) Patent No.: US 9,373,430 B2
(45) Date of Patent: Jun. 21, 2016

(54) RESISTOR COMPONENT

(71) Applicant: Viking Tech Corporation, Hsinchu County (TW)

(72) Inventors: Shih-Long Wei, Hsinchu County (TW); Shen-Li Hsiao, Hsinchu County (TW); Chien-Hung Ho, Hsinchu County (TW)

(73) Assignee: VIKING TECH CORPORATION, Hsinchu County (TW)

( * ) Notice: Subject to any disclaimer, the term of this patent is extended or adjusted under 35 U.S.C. 154(b) by 236 days.

(21) Appl. No.: 13/893,423

(22) Filed: May 14, 2013

(65) Prior Publication Data

US 2014/0167911 A1 Jun. 19, 2014

(30) Foreign Application Priority Data

Dec. 13, 2012 (TW) ..... 101224141 U

(51) Int. Cl.

| | |
|---|---|
| ***H01C 1/012*** | (2006.01) |
| ***H01C 1/028*** | (2006.01) |
| ***H01C 1/04*** | (2006.01) |
| ***H01C 1/148*** | (2006.01) |
| ***H01C 7/00*** | (2006.01) |

(52) U.S. Cl.

CPC ..... *H01C 1/028* (2013.01); *H01C 1/04* (2013.01); *H01C 1/148* (2013.01); *H01C 7/003* (2013.01)

(58) Field of Classification Search

CPC ..... H01C 7/00; H01C 1/028; H01C 1/148; H01C 7/003

USPC ..... 338/308

See application file for complete search history.

(56) References Cited

U.S. PATENT DOCUMENTS

| | | | | | |
|---|---|---|---|---|---|
| 2,313,853 | A | * | 3/1943 | Veley | 338/227 |
| 2,405,449 | A | * | 8/1946 | Robinson et al. | 428/368 |
| 3,539,309 | A | * | 11/1970 | Helgeland | 29/593 |
| 3,880,609 | A | * | 4/1975 | Caddock | 29/620 |
| 3,881,162 | A | * | 4/1975 | Caddock | 338/61 |
| 3,921,119 | A | * | 11/1975 | Caddock | 338/217 |
| 3,982,218 | A | * | 9/1976 | Adler et al. | 338/22 R |
| 4,132,971 | A | * | 1/1979 | Caddock, Jr. | 338/61 |
| 4,146,957 | A | * | 4/1979 | Toenshoff | 29/612 |
| 4,159,459 | A | * | 6/1979 | Sease et al. | 338/61 |
| 4,176,336 | A | * | 11/1979 | Van Den Berk et al. | 338/274 |
| 4,213,113 | A | * | 7/1980 | Brandt et al. | 338/309 |
| 4,665,377 | A | * | 5/1987 | Harpaintner | 338/195 |
| 4,727,350 | A | * | 2/1988 | Ohkubo | 338/21 |
| 4,866,411 | A | * | 9/1989 | Caddock | 338/62 |
| 4,992,772 | A | * | 2/1991 | Kubota et al. | 338/308 |
| 5,889,459 | A | * | 3/1999 | Hattori et al. | 338/9 |
| 5,990,781 | A | * | 11/1999 | Kambara | 338/309 |

(Continued)

*Primary Examiner* — Kyung Lee

(74) *Attorney, Agent, or Firm* — Davis & Bujold PLLC; Michael J. Bujold

(57) ABSTRACT

A resistor component is provided, including a ceramic bar having a film applied thereon, a protection layer formed on the film in a middle portion of the ceramic bar, an end plating layer formed on the film at two ends of the ceramic bar, an insulation layer formed on the protection layer, and a color coded marking formed on the insulation layer that indicates the resistance of the resistor component. The end plating layer is formed by a barrel plating method and includes copper, tin, nickel and a combination thereof. The resistor component thus has a low cost and is manufactured by a simple process, simultaneously avoids the occurrence of pores or incompletely sealed join that may be caused by the prior method. Therefore the resistor component has high reliability.

7 Claims, 4 Drawing Sheets

(56) References Cited

U.S. PATENT DOCUMENTS 6,070,787 A * 6/2000 Harada et al. ..... 228/164
6,317,024 B1 * 11/2001 Orii ..... 338/276
6,356,184 B1 * 3/2002 Doi et al. ..... 338/309
6,647,779 B2 * 11/2003 Ishiguro et al. ..... 73/204.26
6,943,662 B2 * 9/2005 Tanimura ..... 338/309
8,203,422 B2 * 6/2012 Naito et al. ..... 338/308
2010/0134235 A1 * 6/2010 Yoshioka ..... H01C 1/142 338/21

* cited by examiner

RESISTOR COMPONENT

BACKGROUND OF THE INVENTION

1. Field of the Invention

This invention relates to electronic component structures, and, more particularly, to a resistor component having high reliability.

2. Description of Related Art

With the development of technology, the life cycle of electronic products gradually shorten. Electronic components manufacturers always pursue the minimization, low cost, high efficiency, or fast production process during the development of electronic components so that their products may be competitive in the market.

During the development of electronic components, except committing to upgrade the product efficacy, the manufacturers further prefer to occupy the market before others, therefore, product with cheap price and low cost becomes the objective people pursue no matter what kind of electronic components such as capacitor or resistor. As shown in FIGS. 1A and 1B, a ceramic bar 10 is provided, and a film 11 is applied on a surface of the ceramic bar 10 as a resistive layer. Then, as shown in FIG. 1C, the two ends of the ceramic bar 10 coated by the film 11 can be inlaid with two copper-ti or nickel iron caps 12 by using an assembly machine, and adjust to a preferred resistance by resistance cutting. Afterward, as shown in FIGS. 1D and 1F, an insulation layer 13 is formed on the film 11 in a middle portion of the ceramic bar 10, and a color coded marking 14 is coated in a region where the insulation layer 13 is applied to indicate the resistance and error range of the electronic component. At the positions of iron caps 12 on the two ends of the electronic components, that is to say, where the insulation layer 13 is not coated on, tin layers 15 are platted by a barrel plating method to make the iron cap 12 have solderability. An electronic component can be produced by the production steps described above. However, in the prior electronic component, the joint between iron cap 12 and the ceramic bar 10 is not be sealed completely, and if there is a spacing the electricity will be influenced by the contact resistance, in particular may have the risk of dropping out. Furthermore, moisture will easily enter the resistor component and cause the poor thermal conductivity at high temperature. The influence of temperature may result in resistance shift, even the coefficient of thermal expansion (CTE) mismatch issue.

Therefore, how to find a simple production structure of a resistor component to provide a resistor component with high yield and low cost, particularly, present resistor components all have iron caps inlaid to provide heat diffusion, but there may be issues, for example, poor heat conductivity and incompletely sealed, thus how to solve the possible issues caused by electronic components with iron cap inlaid is a substantial objective to pursue.

SUMMARY OF THE INVENTION

In view of the above-mentioned problems of the prior art, the objective of the present invention is to provide a resistor component structure, which forms a structure by using a barrel plating method having the same effect with the prior iron cap method.

In order to achieve previous mentioned and other objectives, the present invention provides a resistor component, comprising: a ceramic bar having a film applied thereon, a protection layer formed on the film in a middle portion of the ceramic bar, an end plating layer formed on the film at two ends of the ceramic bar, an insulation layer formed on the protection layer; and a color coded marking formed on the insulation layer.

In an embodiment, the end plating layer comprises copper, tin, nickel, or a combination thereof, and is formed by the barrel plating method.

In another embodiment, the insulation layer is formed before the protection layer, and the resistance of the resistor component is adjusted by cutting the film, which is performed by a laser cutting machine or a laser slicer.

Compared with the prior art, the resistor component of the present invention does not apply the method with iron caps inlaid, but by barrel slating to form end slating having the same effect with the prior iron caps method. Not only has higher yield but decrease the cost, furthermore, by using barrel plating the present invention solves issues in the prior method including the joint between iron cap and ceramic bar may have a spacing and an incomplete sealed joint which may influence the electricity or cause the mismatch of thermal expansion. Therefore, the proposed resistor component with high yield and low cost in the present invention, simultaneously simplify the production process, is substantially beneficial to the structure and production of resistor components.

BRIEF DESCRIPTION OF DRAWINGS

The invention can be more fully understood by reading the following detailed description of the preferred embodiments, with reference made to the accompanying drawings, wherein.

DETAILED DESCRIPTION OF THE INVENTION

The following illustrative embodiments are provided to illustrate the disclosure of the present invention, these and other advantages and effects can be apparently understood by those in the art after reading the disclosure of this specification. The present invention can also be performed or applied by other different embodiments. The details of the specification may be on the basis of different points and applications, and numerous modifications and variations can be devised without departing from the spirit of the present invention.

It should be advised that the structure, ratio, and size as illustrated in this context are only used for the disclosure of this specification, provided for those in the art to understand and read, do not have substantial meaning technically. Any modification of the structure, change of the ratio relation, or adjustment of the size should be involved in the scope of the disclosure in the present invention without influencing the producible efficacy and the achievable objective of the present invention.

Please refer to FIGS. 2A to 2F, which are the cross-sectional diagrams illustrating a method of manufacturing a resistor component according to the present invention. As shown in the figures, the production process of the resistor component is presented by sectional diagrams, it has to indicate that in the prior resistor component, the two electrodes have iron caps inlaid to increase the heat diffusion effect of the resistor component. However, the usage of iron caps would occur pores or incompletely sealed joint which can cause issues like the influence of the resistor component electricity and thermal expansion mismatch. Thus considering factors like cost and yield without overly changing the production process, the present invention proposes a structure of the resistor component.

Figure 1A:
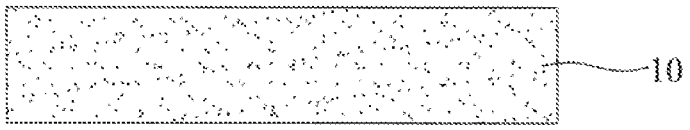
FIG. 1A (PRIOR ART)
FIGS. 1A to 1F are cross-sectional schematic diagrams illustrating a method of manufacturing a resistor component according to the prior art.
Figure 1B:
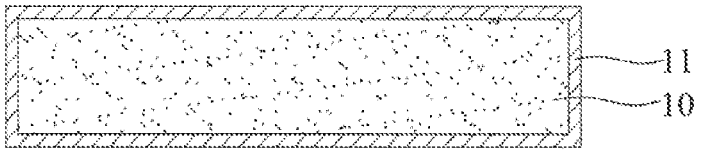
FIG. 1B (PRIOR ART)
Figure 1C:
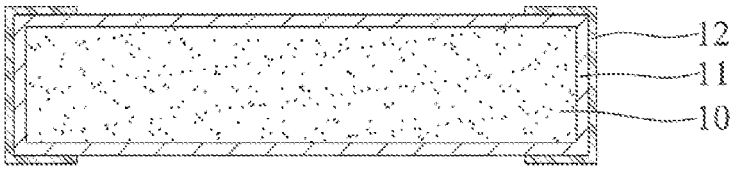
FIG. 1C (PRIOR ART)
Figure 1D:
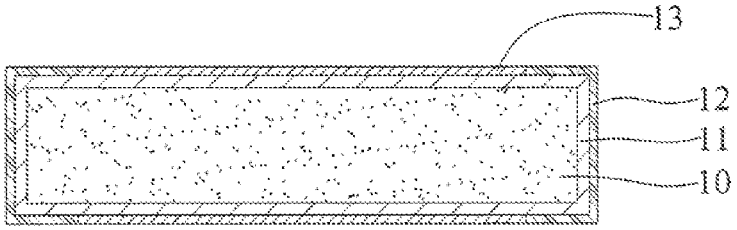
FIG. 1D (PRIOR ART)
Figure 1E:
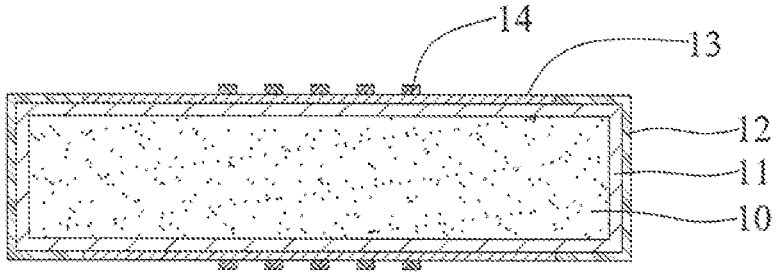
FIG. 1E (PRIOR ART)
Figure 1F:
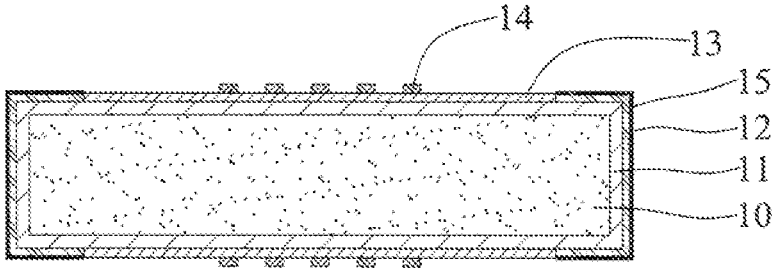
FIG. 1F (PRIOR ART)
Figure 2A:
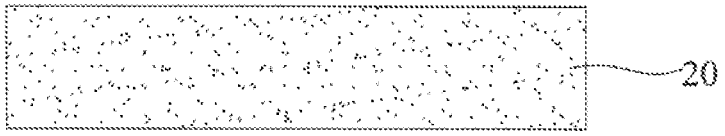
FIGS. 2A to 2F are cross-sectional schematic diagrams illustrating a method of manufacturing a resistor component according to the present invention.
Figure 2B:
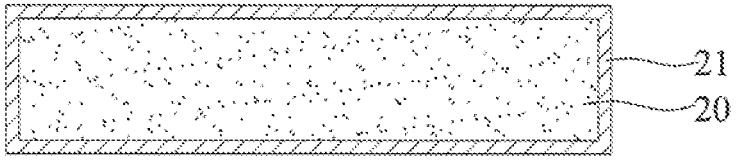
Figure 2C:
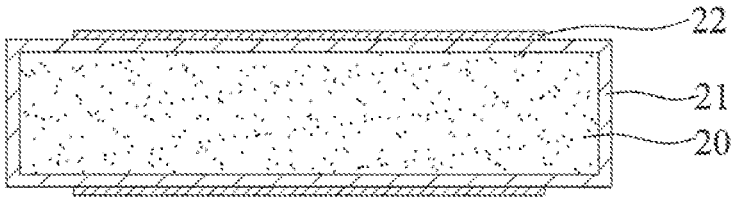
Figure 2D:
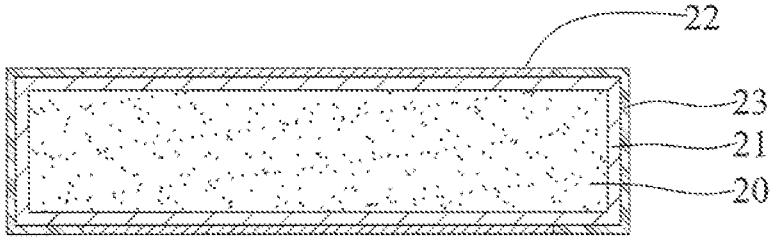
Figure 2E:
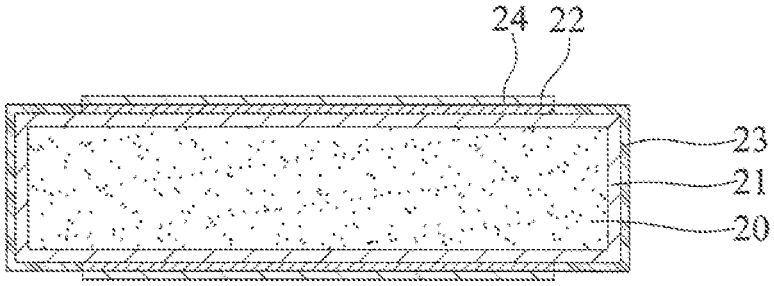
Figure 2F:
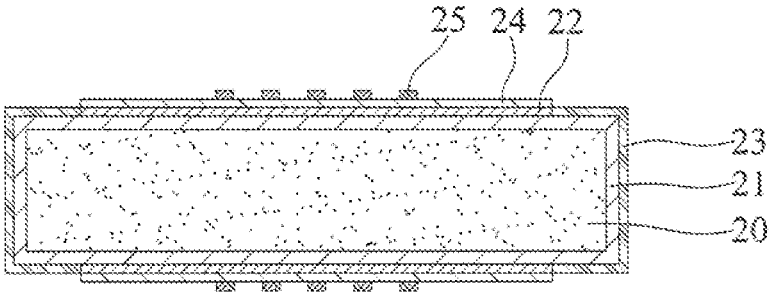

The structure of the resistor component in the present invention is shown in FIG. 2F. The resistor component comprises a ceramic bar 20 having a film 21 applied thereon, a protection layer 22 formed on the film 21 in a middle portion of the ceramic bar 20 to protect the middle portion of the ceramic bar 20 during the subsequent plating process, an end plating layer 23 formed on the film 21 at two ends of the ceramic bar 20 wherein the end plating layer 23 has similar effect with the prior iron caps, an insulation layer 24 formed on the protection layer 22, and a color coded marking 25 formed on the insulation layer 24 that indicates the resistance of the resistor component.

In an embodiment, the end plating layer 23 comprises copper, tin, nickel, or a combination thereof, which is different from the prior inlaid iron caps method. In an embodiment, the end plating layer 23 is formed by the barrel plating method where the described barrel plating is one of the plating methods to form copper, tin, and nickel on the surface of two ends of the ceramic bar 20 by using the barrel plating method, and is advantageous to reduce the occurrence of pores or incompletely sealed joint to promote the resistor component yield and the product reliability.

In order to fully describe the forming method of the structure of the resistor component in the present invention, the following will specify the production process of the resistor component in the present invention with reference made to the accompanying FIGS. 2A to 2F.

As shown in FIG. 2A, the ceramic bar 20 provided. In an embodiment, the ceramic bar 20 is in the shape of a bar and is formed by 96% or 85% of alumina ($Al_2O_3$).

As shown in FIG. 2B, the film 21 is applied on a surface of the ceramic bar 20. In an embodiment, the film 21 is nickel-chromium, ferromanganese, nickel-chromium silicon, chrome silicon, or nickel, and can be formed by a sputtering method or a chemical plating method. The film 21 acts as a resistive layer.

As shown in FIG. 2C, the protection layer 22 is formed on the film 21 in the middle portion of the ceramic bar 20. The protection layer 22 can be an epoxy resin and can be coated by the coating machine. The protection layer 22 protects the middle portion of the ceramic bar 20 so that the middle portion which is not needed to be plated will be protected during the subsequent plating process.

As shown in FIG. 2D, the end plating layer 23 is formed on the film 21 at two ends of the ceramic bar 20. In an embodiment, the end plating layer 23 is located at the same place as the prior iron caps which connect with the ceramic bar by inlaying method. In this embodiment, the end plating layer 23 is formed by electroplating method, wherein the described electroplating is performed by barrel plating. The copper, tin, or nickel barrel plated on the end plating layer 23 provides the heat diffusion effect of the resistor component. From the above, the end plating layer 23 of the present invention is formed by the barrel plating method so there is no occurrence of pores or incompletely sealed joint caused by inlaying, thus is advantageous to the resistor component yield and the product reliability.

After the formation of the protection layer 22 in the middle portion of the ceramic bar 20 and the end plating layer 23 at the two ends of the ceramic bar 20, a resistance cutting process is performed on the resistor component. By the method using a laser cutting machine or a laser slicer to cut the film, the resistance of the resistor component can be adjusted to a certain value, and the protection layer 22 can be directly destroyed during the resistance cutting process without influencing the structure of the resistor component.

As shown in FIG. 2E, the insulation layer 24 is formed on the protection layer 22, specifically, coat another layer, the insulation layer 24, in the middle portion of the ceramic bar 20. This can also be performed by a coating machine to form the coating, and the insulation layer 24 may be an epoxy resin resin.

As shown in FIG. 2F, the color coded marking 25 is formed on the insulation layer 24. In an embodiment, the color coded marking 25 surrounds the ceramic bar 20 body to form and is located in the middle portion of the ceramic bar 20. This can be performed by a coating machine to form the coating, and the color coded marking 25 may be an epoxy resin. The color coded marking 25 indicates the resistance and error range of the resistor component. The color coded marking 25 uses circular color belts to show the resistance and it may be an alternative when there is no enough surface area on the resistor to show resistance by numbers, thus can provide users through color coded marking 25 to calculate the resistance of the resistor component.

Compared with the prior art, the resistor component in this invention applies barrel plating method to form end plating layer which has the same effect with the prior iron caps method. Since the end plating layer is formed by barrel plating method, occurrence such as pores or incompletely sealed joint may be avoided, thus electricity influence, iron caps dropping out, or thermal expansion mismatch issues caused by incompletely sealed joint may be solved. Furthermore, the formation of pores will make the moisture easily enter and resistor component have poor heat diffusion causing the resistance shift at high temperature, therefore, the formation method of end plating layer in the present invention not only increase the yield of resistor component but also barrel plating has a lower cost than using iron caps. Simultaneously the possible defect of using iron caps can be avoided, thus the resistor component in the present invention substantially has high product reliability and value.

The foregoing descriptions of the detailed embodiments are only illustrated to disclose the features and functions of the present invention and not restrictive of the scope of the present invention. It should be understood to those in the art that all modifications and variations according to the spirit and principle in the disclosure of the present invention should fall within the scope of the appended claims.

What is claimed is:

1. A resistor component comprising:

a ceramic bar in a bar shape and having a film applied on a whole surface of the ceramic bar;

a protection layer formed on the film in a middle portion of the ceramic bar and having an even thickness;

an end plating layer formed on the film at two ends of the ceramic bar by a barrel plating method;

an insulation layer formed on the protection layer; and a color coded marking formed on the insulation layer.

2. The resistor component of claim 1, wherein the film acts as a resistive layer.

3. The resistor component of claim 1, wherein the end plating layer comprises copper, tin, nickel, or a combination thereof.

4. The resistor component of claim 1, wherein before the insulation layer is formed on the protection layer, a resistance of the resistor component is adjusted by cutting the film.

5. The resistor component of claim 4, wherein the film is cut by a laser cutting machine or a laser slicer.

6. The resistor component of claim 1, wherein the protection layer is made of epoxy resin.

7. The resistor component of claim 1, wherein the color coded marking is made of epoxy resin.

* * * * *